US009707688B2

(12) United States Patent
Giannopoulos et al.

(10) Patent No.: US 9,707,688 B2
(45) Date of Patent: Jul. 18, 2017

(54) SHAVER

(71) Applicant: BIC-VIOLEX SA, Anixi, Attiki (GR)

(72) Inventors: Panagiotis Giannopoulos, Ilion (GR); Dimitrios Efthimiadis, Nea Kypseli (GR); Phaedon Papadopoulos-Papageorgis, Agios Stefanos (GR)

(73) Assignee: BIC VIOLEX S.A., Anixi (GR)

( * ) Notice: Subject to any disclaimer, the term of this patent is extended or adjusted under 35 U.S.C. 154(b) by 205 days.

(21) Appl. No.: 14/648,305

(22) PCT Filed: Dec. 21, 2012

(86) PCT No.: PCT/EP2012/076807
§ 371 (c)(1),
(2) Date: May 29, 2015

(87) PCT Pub. No.: WO2014/094909
PCT Pub. Date: Jun. 26, 2014

(65) Prior Publication Data
US 2015/0290819 A1 Oct. 15, 2015

(51) Int. Cl.
*B26B 21/22* (2006.01)
*B26B 21/52* (2006.01)

(52) U.S. Cl.
CPC ..... *B26B 21/225* (2013.01); *B26B 21/222* (2013.01); *B26B 21/227* (2013.01); *B26B 21/521* (2013.01)

(58) Field of Classification Search
CPC ... B26B 21/225; B26B 21/222; B26B 21/227; B26B 21/521; B26B 21/14; B26B 21/165; B26B 21/22; B26B 21/4012; B26B 21/52
USPC ..... 30/532, 51, 57, 58, 60, 527
See application file for complete search history.

(56) References Cited

U.S. PATENT DOCUMENTS 5,669,139 A * 9/1997 Oldroyd ..... B26B 29/00 30/47
8,732,965 B2 * 5/2014 Efthimiadis ..... B26B 21/521 30/526
2004/0181953 A1 * 9/2004 Follo ..... B26B 21/521 30/527

(Continued)

FOREIGN PATENT DOCUMENTS

EP 1 935 588 A1 6/2008
GB 2471676 A 1/2011

(Continued)

OTHER PUBLICATIONS

International Report of PCT/EP2012/076807; Sep. 10, 2013.

*Primary Examiner* — Phong Nguyen
(74) *Attorney, Agent, or Firm* — Polsinelli PC

(57) ABSTRACT

A shaver is provided, the shaver including a handle with an elongated handgrip portion and a mounting portion, a shaver head pivotally attached to the mounting portion, a removable cartridge including at least one blade, the cartridge being adapted to be attached to the shaver head and removed from the shaver head, a pusher, adapted to encounter the cartridge to release the cartridge from the shaver head, and a spring provided on the shaver head, the spring being adapted to attach the cartridge to the shaver head, the spring comprising at least one part which forms a loop.

13 Claims, 7 Drawing Sheets

(56) References Cited

U.S. PATENT DOCUMENTS

2010/0205808 A1* 8/2010 King ..... A45D 27/225
30/34.2

FOREIGN PATENT DOCUMENTS

GB WO2014/075844 * 11/2012
WO WO 93/10946 A1 6/1993

* cited by examiner

SHAVER

This application is a national stage application of International Application No. PCT/EP2012/076807, filed on Dec. 21, 2012, the entire contents of which are incorporated herein by reference.

FIELD OF INVENTION

The embodiments of the present invention relate to a shaver with interchangeable cartridges, and to cartridges and head and handle assemblies for such shavers.

More particularly, the embodiments of the present invention relate to a shaver that includes:

a handle with an elongated body terminating in a mounting portion for retaining a shaver head, a shaver head adapted to accommodate an interchangeable shaving cartridge, a lock-and-release mechanism to enable the interchangeable shaving cartridge to be loaded and ejected from the shaver head, and an interchangeable cartridge containing one or more blades.

Such a shaver enables the user to replace the cartridge once the blade or blades become worn, while the handle and the shaver head can be kept and reused.

BACKGROUND OF THE INVENTION

The removal from the shaver head of the interchangeable blade cartridges, such as those disclosed in e.g. EP2195145, usually requires the user to press or pull the cartridge to actually displace the cartridge. This means that to replace the cartridge, the user needs to encounter the cartridge by his/her fingers. Therefore the risk of the injury of the user is increased.

SUMMARY OF THE INVENTION

A shaver is provided, the shaver that includes a handle with an elongated handgrip portion and a mounting portion, a shaver head, the shaver head being pivotally attached to the mounting portion, a removable cartridge, the cartridge that includes at least one blade, the cartridge being adapted to be attached to the shaver head and removed from the shaver head, a pusher, adapted to encounter the cartridge to release the cartridge from the shaver head, and a spring provided on the shaver head, the spring being adapted to attach the cartridge to the shaver head, wherein the spring comprises at least one part which forms a loop In some embodiments, one may also use one or more of the following features:

the shaver head further comprises a back structure, and the spring is attached to the back structure of the shaver head, the cartridge is ejected in a direction perpendicular to the direction of shaving, the spring is made of a curved wire, the spring is omega-shaped, the spring is made of metal, the shaver head further comprises a bottom wall and a guard member, the guard member being positioned adjacent the bottom wall, the cartridge comprises a holder, the holder being provided in a form of a cylinder-shaped body, the holder being adapted to cooperate with the spring, the holder comprises a groove, the groove being adapted to cooperate with the loop formed by the spring, the handle further comprises a rotating button, and the button further comprises a pusher, the pusher being adapted to encounter the holder of the cartridge and thus release the cartridge from the shaver head.

In another aspect of the present invention, a cartridge is provided, the cartridge that includes a holder, the holder being provided in a form of a cylinder-shaped body.

In some embodiments, one may also use one or more of the following features:

the holder further comprises a groove, the cartridge comprises at least one blade, the at least one blade being mounted movably, the cartridge further comprises a top wall and a shaving aid, the shaving aid being positioned in the top wall.

In another aspect of the present invention, a head and handle assembly is provided, the head and handle assembly that includes a handle with an elongated handgrip portion and a mounting portion, a shaver head, the shaver head being pivotally attached to the mounting portion, the shaver head being adapted to receive a cartridge, a spring provided on the shaver head, the spring being adapted to attach a cartridge to the shaver head, wherein the spring comprises at least one part which forms a loop.

In some embodiments, one may use one or more of the following features:

the shaver head further comprises a back structure, and the leaf spring is attached to the back structure, the spring is made of a curved wire, and the spring is omega-shaped.

With these features, when the cartridge is to be removed from the shaver head, it is more easily ejected from the shaver head. The user does not have to push or pull the cartridge and the risk of injury of the user is lowered. Moreover, as only the cartridge is replaced when the blades become worn, instead of replacing the whole shaver head, the costs of such shaver are kept lower. Further, as only the cartridge is replaced, the shaver is both easier to manufacture and more environment friendly, as the amount of material to be replaced (and disposed of) is reduced.

In yet another aspect of the present invention, a shaver is provided, the shaver that includes a handle with an elongated handgrip portion and a mounting portion, a shaver head, the shaver head being pivotally attached to the mounting portion, a removable cartridge, the cartridge that includes at least one blade, the cartridge being adapted to be attached to the shaver head and removed from the shaver head, and a button, the button being adapted to be rotated about an axis parallel to the pivoting axis, wherein the button, when rotated, facilitates the removal of the cartridge from the shaver head.

In some embodiments, one may also use one or more of the following features:

the shaver comprises a cam follower, the cam follower is adapted to be rotated about an axis parallel to the pivoting axis, and the cam follower provides a return force for the shaver head, when the shaver head is pivoted, the button comprises a pusher, the pusher is adapted to remove the cartridge from the shaver head, the cartridge further comprises a holder, the holder attaching the cartridge to the shaver head, and the pusher encounters the holder to remove the cartridge from the shaver head, the shaver comprises a leaf spring, the leaf spring being adapted to provide a return force for the button and/or the cam follower, the leaf spring comprises a base portion, a pair of outer branches and a middle branch, the outer branches of the leaf spring cooperate with the button to provide a return force for the button, the middle branch of the leaf spring cooperates with the cam follower to provide a return force for the cam follower, the branches of the leaf spring have ends that are bent upwards, the leaf spring is made of metal, the button comprises a pair of legs, the legs attaching the button to the handle, the cam follower is accommodated between the legs of the button, the shaver head further comprises a spring, the spring being adapted to attach the cartridge to the shaver head, the spring is omega-shaped, the cartridge is ejected in a direction perpendicular to the direction of shaving.

BRIEF DESCRIPTION OF THE DRAWINGS

Other characteristics and advantages of the invention will readily appear from the following description of one of its embodiments, provided as a non-limitative examples, and of the accompanying drawings.

On the drawings.

On the different Figures, the same reference signs designate like or similar elements.

DETAILED DESCRIPTION

Figure 1A:
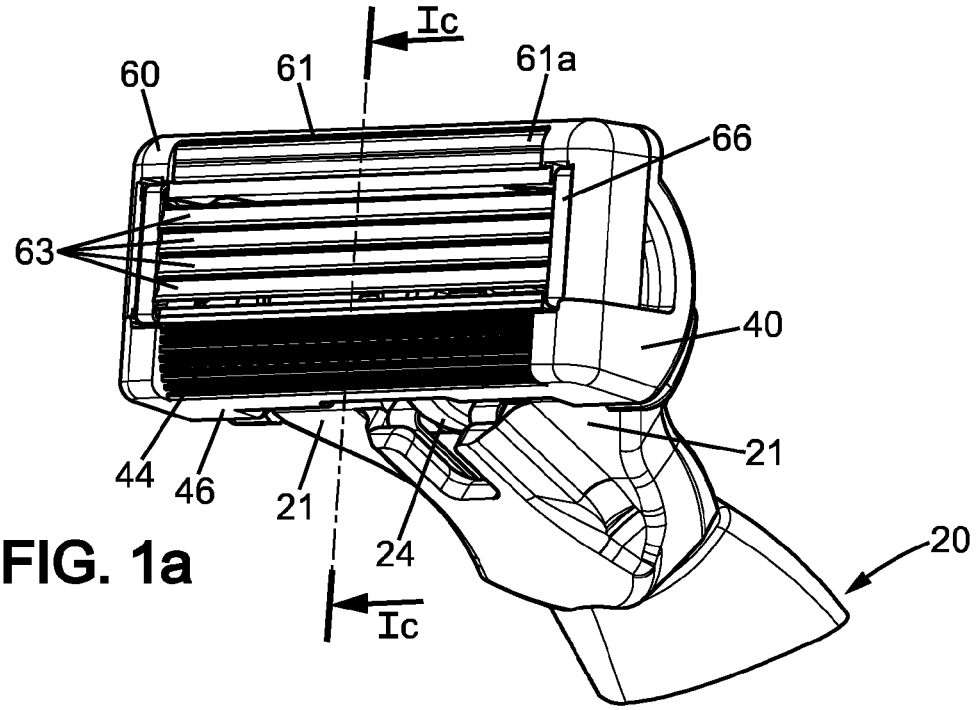
FIG. 1*a* shows an overall view of a shaver according to one embodiment of the invention, viewed from the front side.
Figure 1B:
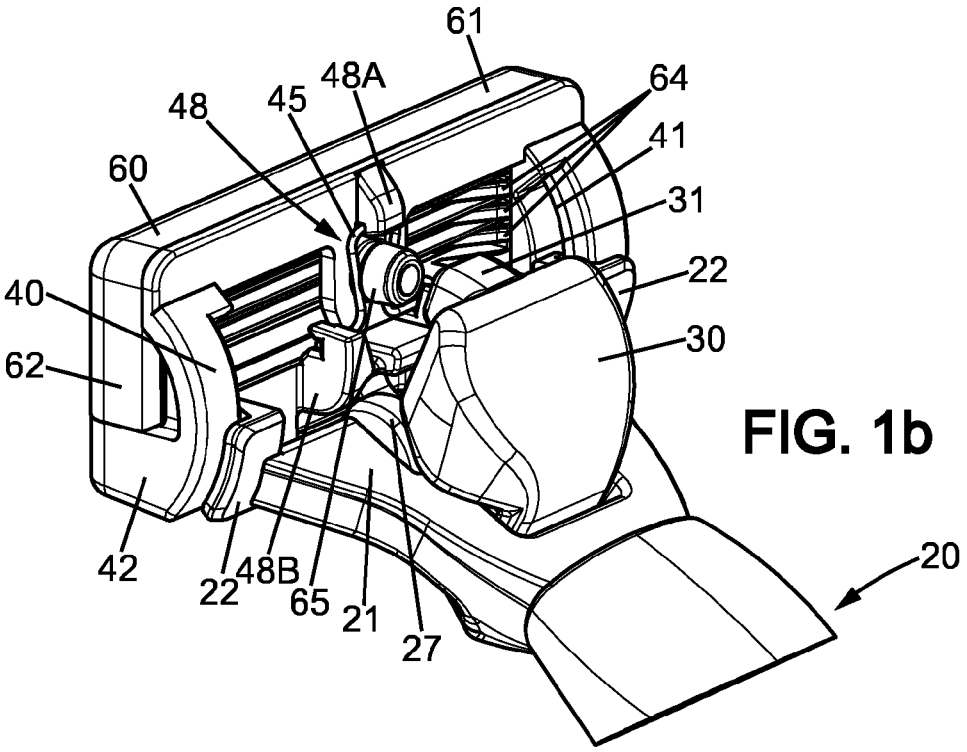
FIG. 1*b* shows an overall view of the shaver of FIG. 1 from the back side.
Figure 1C:
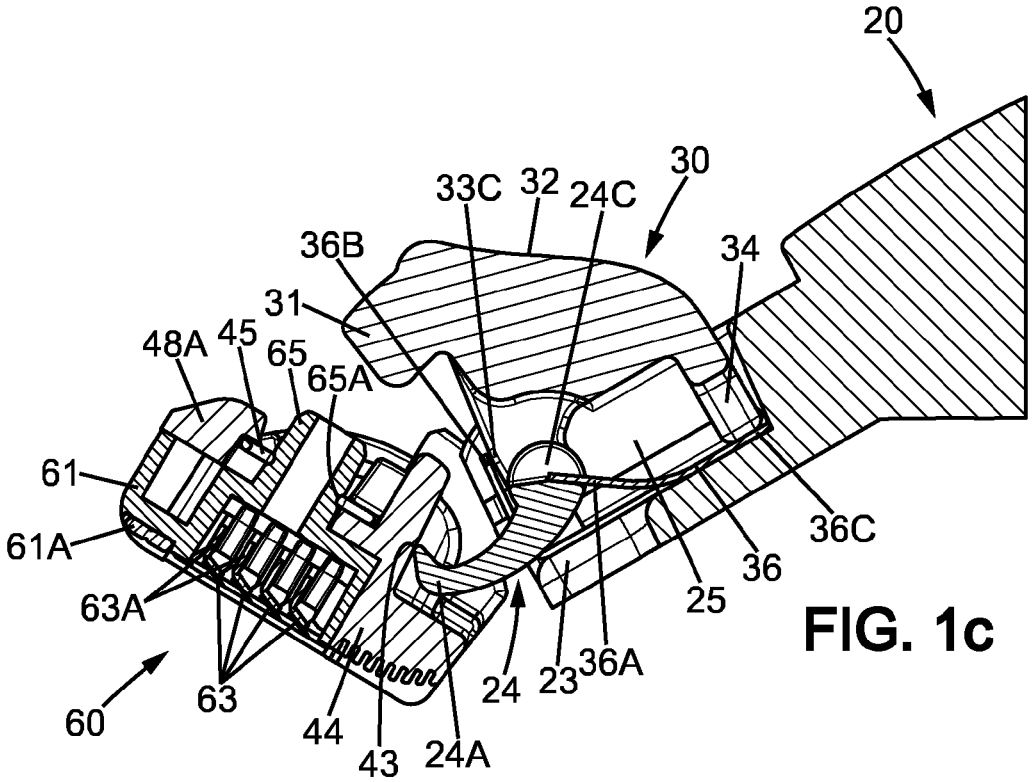
FIG. 1*c* shows a cross-section of the shaver of FIG. 1, along line Ic, with the shaver head in the neutral position

FIGS. 1*a* to 1*c* show an example of a shaver according to the present invention. The shaver comprises a handle 20, a shaver head 40 and a cartridge 60, which accommodates one or more blades 63. On the example shown on the Figures, there are four blades. However, the cartridge may also use more or less of blades.

Figure 3A:
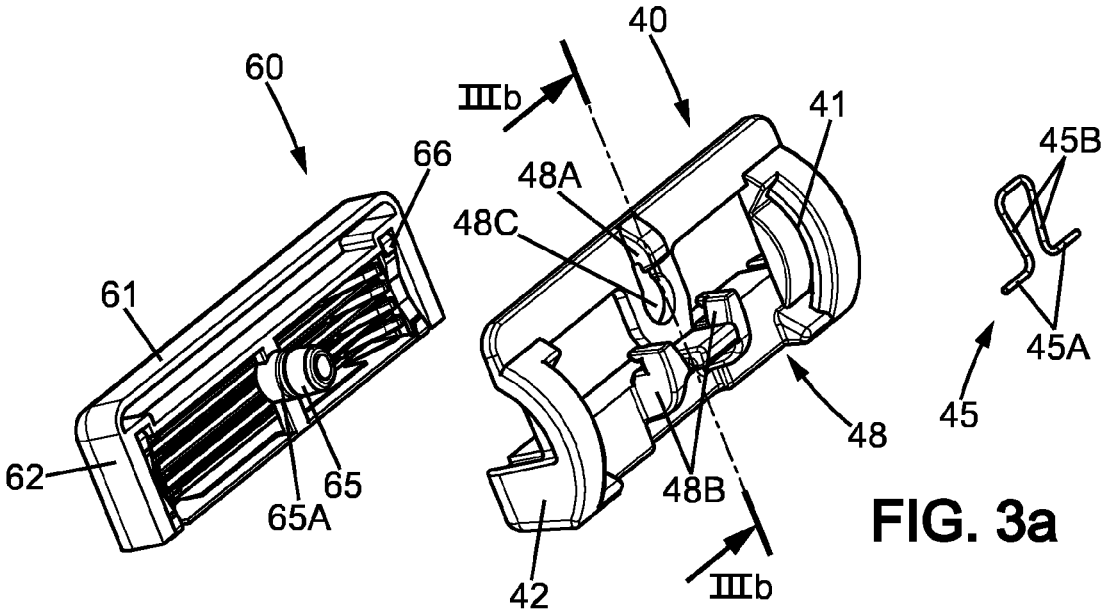
FIG. 3*a* shows the shaver head and the cartridge of the shaver of FIG. 1, as seen from the back.
Figure 3B:
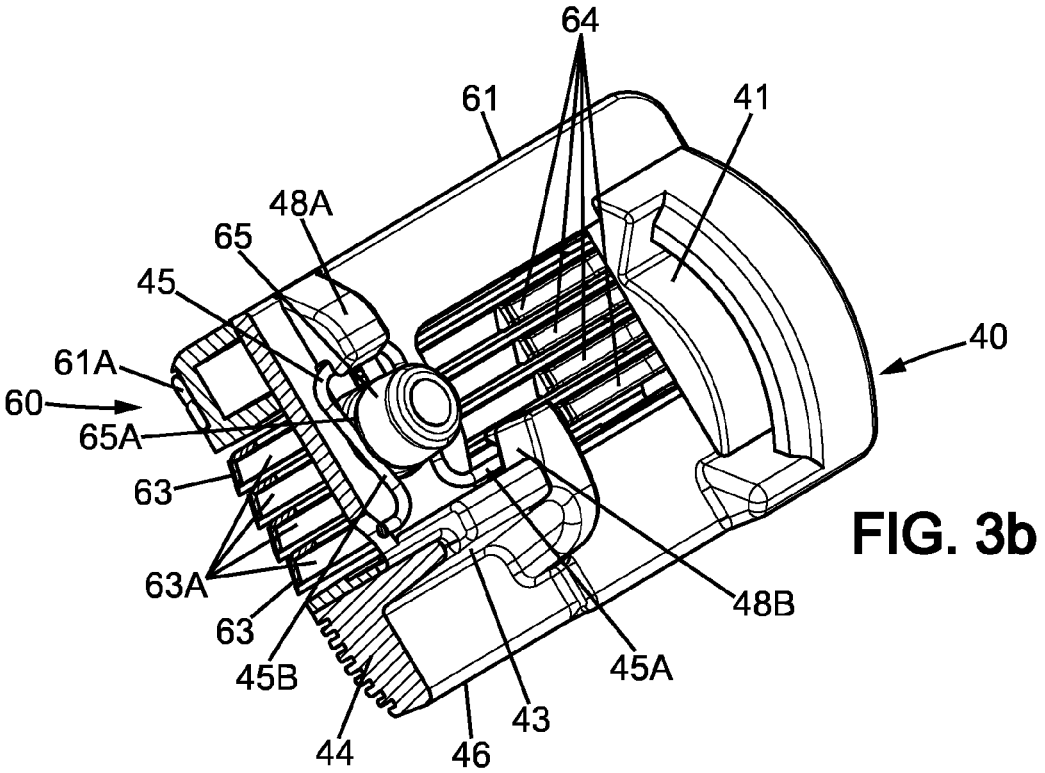
FIG. 3*b* shows a cross-section of the shaver head with the cartridge inserted.
Figure 4:
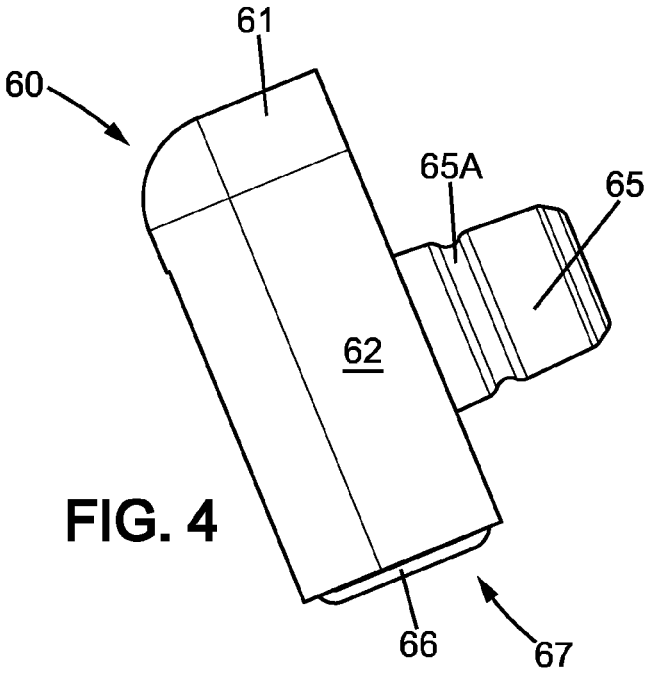
FIG. 4 shows a detail side view of the cartridge.

The cartridge 60 (FIGS. 3*a* and 4) is formed as a frame with a top wall 61, two lateral walls 62, bottom wall 67 and a back structure (seen on FIG. 4). The top wall 61 and the bottom wall 67 are elongated and connected by the lateral walls 62. The frame of the cartridge 60 may be molded out of plastic; preferably, the frame is one-piece. The blades 63 extend between the lateral walls 62, parallel to the top wall 61 and the bottom wall 67. The blades 63 may be made from bent sheet metal, or, preferably, they may be straight and supported with blade supports 63A. The blades 63 and/or the blade supports 63A are then accommodated in seats 63B provided in the lateral walls 62. Moreover, the blades may for instance be placed movably. The lateral walls 62 may be provided with elastic fingers 64, extending towards the insides of the cartridge frame, in a direction parallel to the blades 63, and supporting movably the blades 63. The blades 63 may be held in the cartridge 60 by a pair of bent metal strips 66, which encircle the ends of the blades 63 and thus hold them in place. The number of blades may be for example four. In the top wall 61, lying generally in a plane defined by the blade edges, a shaving aid 61A may be provided. In other embodiments, the blades may be fixed.

The handle 20 has an elongated handgrip portion (not shown) which may be provided with features that enhance grip of the user and help prevent slipping, such as ribs, pegs, elastomeric parts and the like. The handle 20 is preferably molded out of a plastic material. The handle 20 is terminated in two yokes 21 extending from the handle, as shown on FIG. 2. The yokes 21 end in a mounting portion, provided in a form of shell bearings 22. The shell bearings 22 cooperate with complementary depressions 41 provided on the shaver head 40. The shell bearings 22 and the complementary depressions 41 together enable the shaver head 40 to pivot about an axis parallel to the length of the blades 63. Alternatively, the shell bearings 22 may be replaced by hinges, pins or other pivoting means.

The yokes 21 further define a cavity 25, accommodating a button 30 (will be described later). The cavity 25 further comprises a gap 23, positioned between the yokes 21. The gap 23 accommodates a cam follower 24.

In an embodiment shown on FIGS. 2*a* to 2*d*, the cam follower 24 comprises a cylinder-like body. The cylinder-like body defines a rotational axis. The rotational axis is parallel to the pivoting axis defined by the shell bearings 22. In a direction of the rotational axis, from the opposing bases of the cylinder-like body, a pair of pegs 24B protrude. In a plane generally perpendicular to the rotational axis, a beak 24A projects. The beak 24A is preferably bent to form a convex projection. When the cam follower 24 is assembled to the handle 20, the beak 24A projects towards the shaving plane and is bent upwards, towards the shaver head 40. The beak 24A cooperates with a rest 43 provided on the back wall of the shaver head 40, therefore enabling the shaver head 40 to be returned to the neutral position. The cylinder-like body of the cam follower 24 further comprises a depression 24C. The depression 24C accommodates a leaf spring 36. The leaf spring 36 is adapted to provide a return force for the cam follower 24, and thus facilitates the returning of the shaver head 40 to the neutral position.

The leaf spring 36 may be provided in a form of a generally E-shaped body, as shown on FIGS. 2*a* to 2*d*. The leaf spring 36 comprises three branches 36B, 36A, 36B, interconnected by a base portion 36C. The outer branches 36B are provided with an elongated ends, the ends being bent at approximately 90 degrees with respect to the base portion 36C; preferably, the angle is less than 90 degrees but more than 80 degrees. The branches 36B are thus substantially L-shaped. The middle branch 36A is bent in the same direction as the outer branches 36B. Preferably, the angle at which the middle branch is bent is obtuse. Preferably, the middle branch 36A is shorter than the outer branches 36B.

Figure 1D:
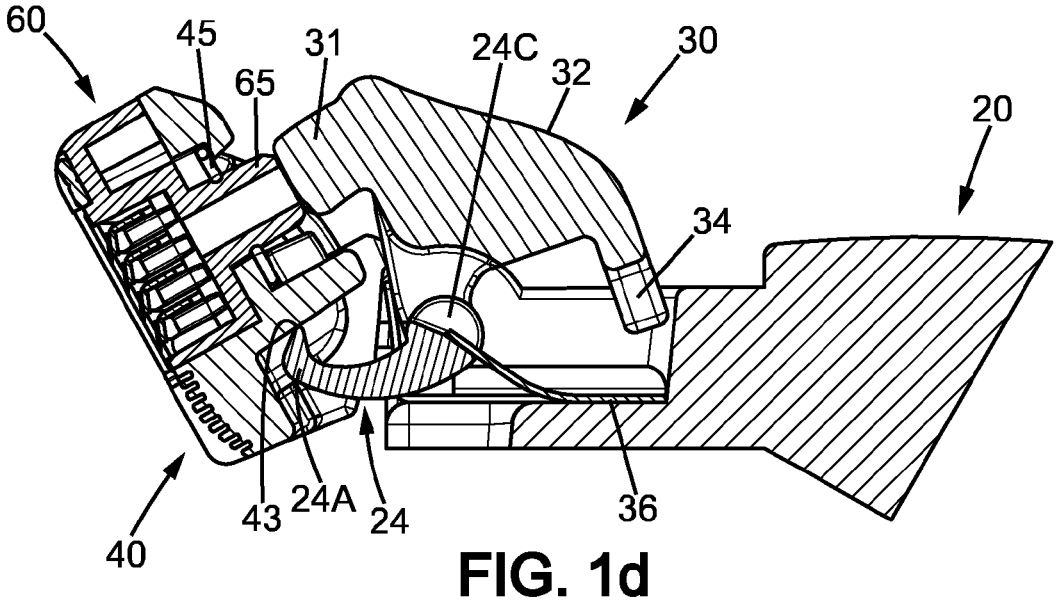
FIG. 1*d* shows a cross-section of the shaver of FIG. 1, along line Ic, with the shaver head in the neutral position, with a button rotated.
Figure 1E:
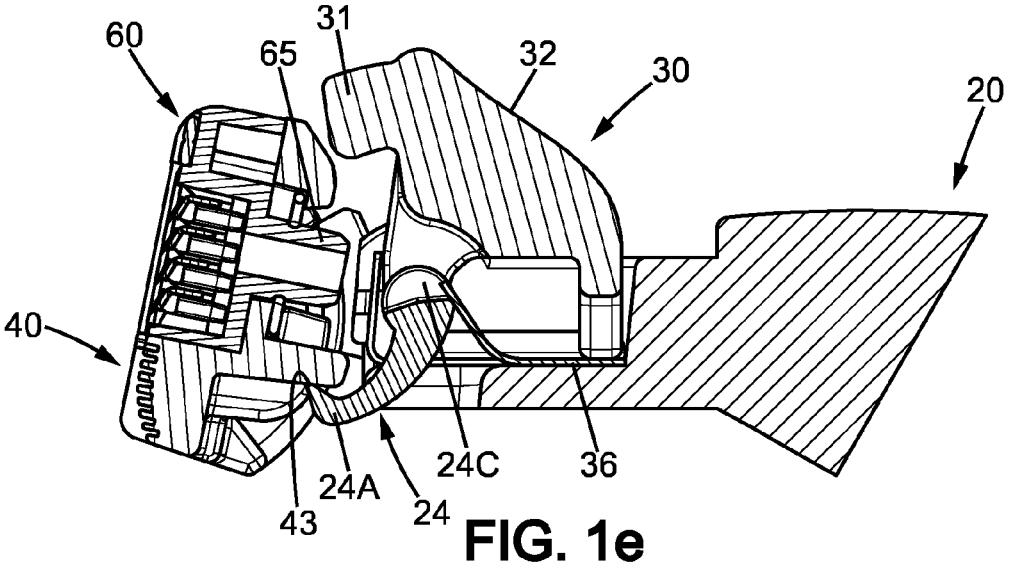
FIG. 1*e* shows a cross-section of the shaver of FIG. 1, along line Ic, with the shaver head in a rotated position
Figure 2A:
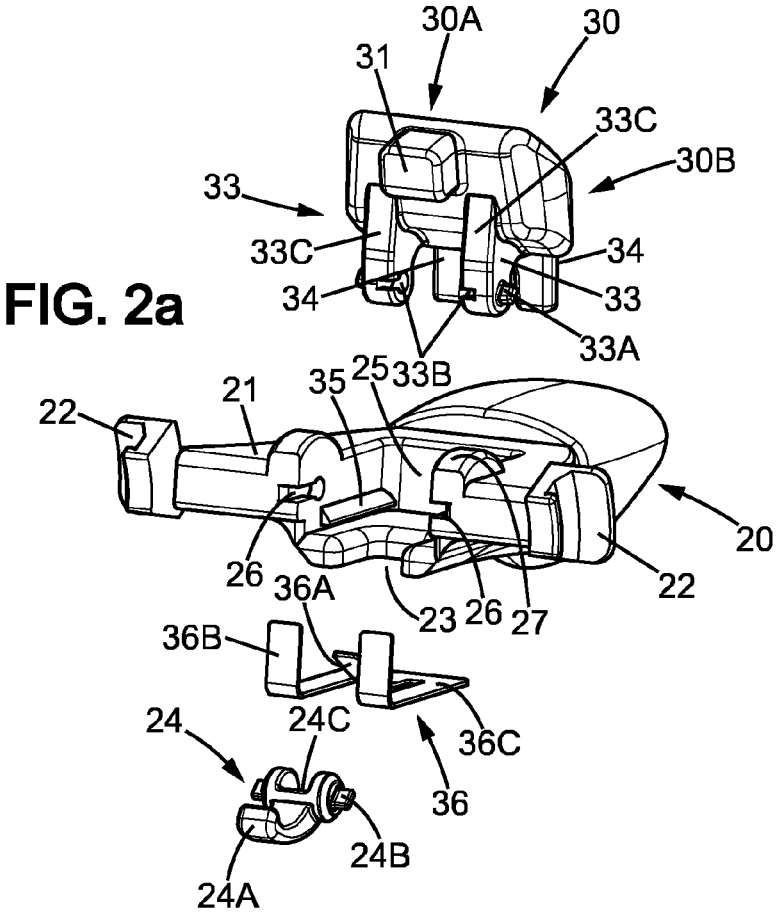
FIGS. 2*a* and 2*b* are two exploded perspective views of head attachment mechanism of the handle of the shaver of FIG. 1, viewed in two directions.
Figure 2B:
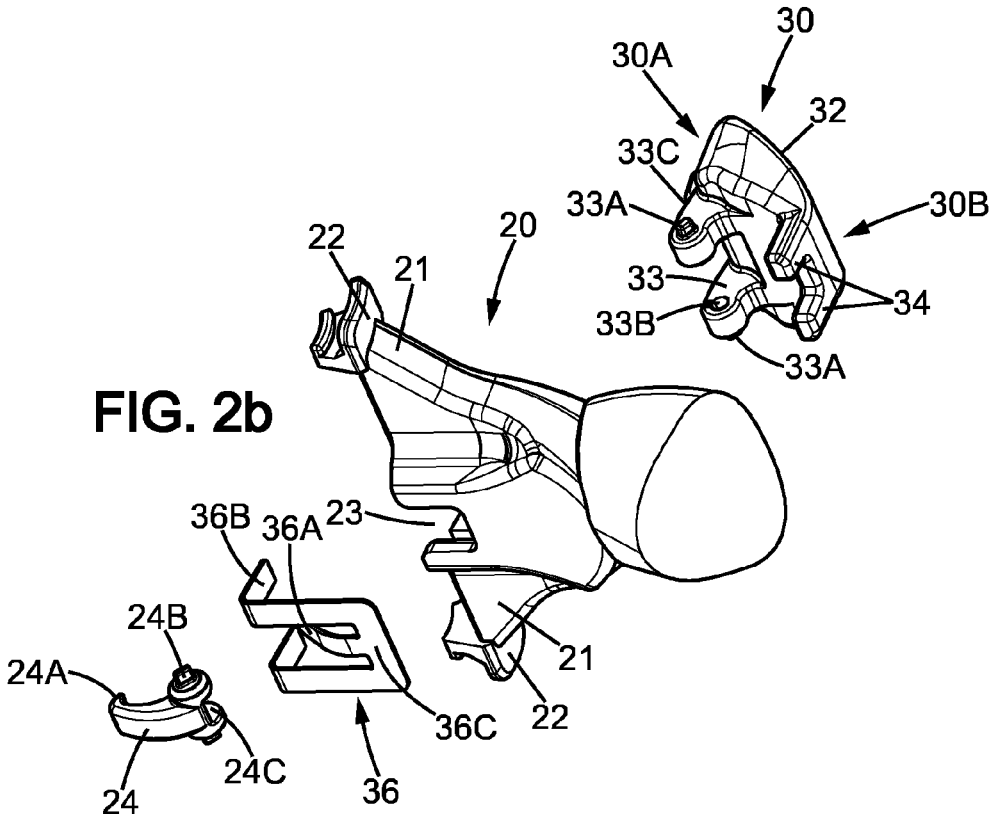
Figure 2C:
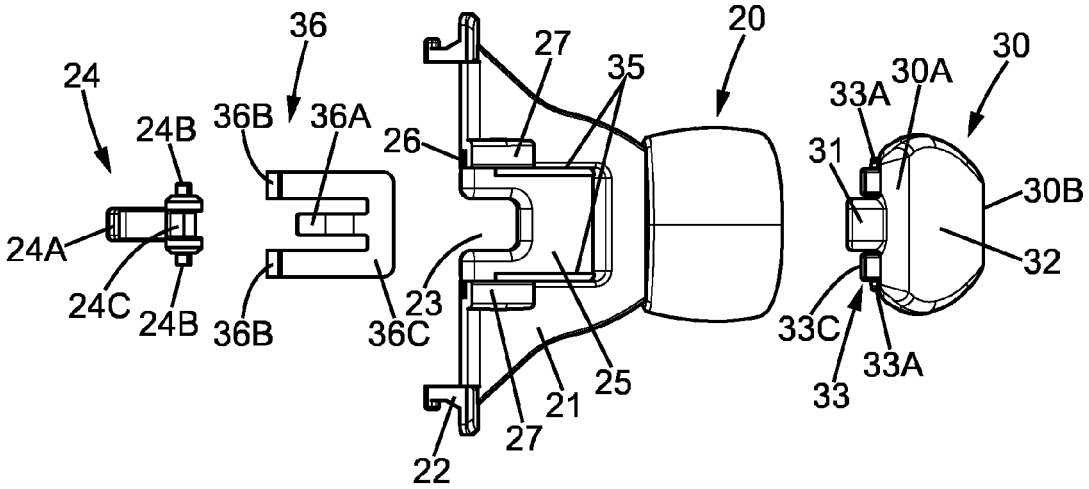
FIG. 2*c* is a top exploded view of the head attachment mechanism.
Figure 2D:
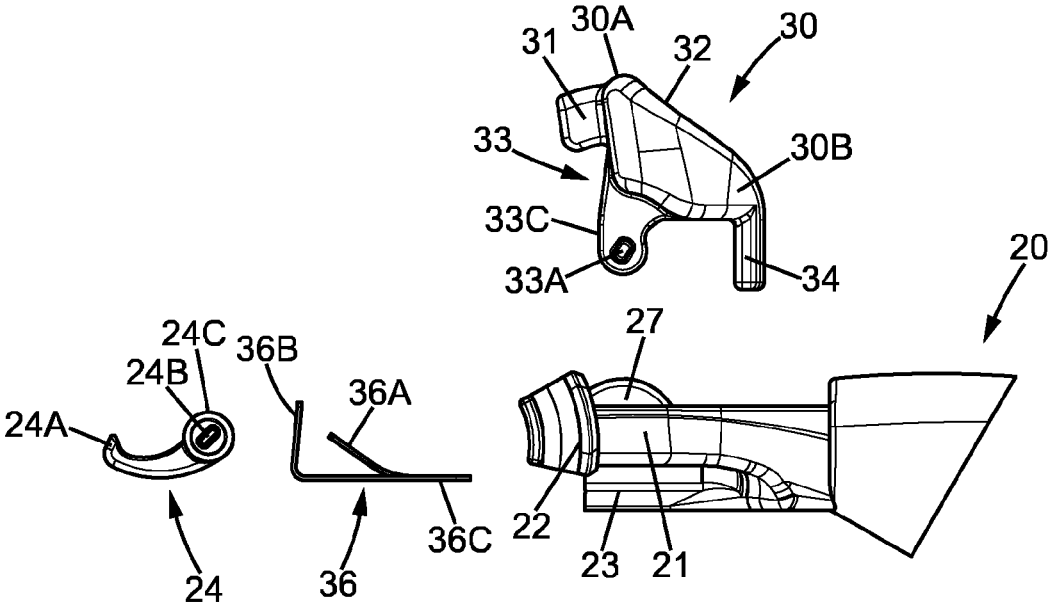
FIG. 2*d* is a side exploded view of the head attachment mechanism.

The leaf spring 36 is positioned so as to have the middle branch 36A positioned in the depression 24C. An example on FIGS. 1*c* and 1*e* shows a position of the head 40 and the cam follower 24 in the neutral position and in rotated position, respectively. In this example, when the head 40 is rotated, the beak 24A of the cam follower 24 is moved downwards in a direction away from the button 30, the middle branch 36A of the leaf spring 36 is bent upwards in a direction towards the button by a bottom wall of the cavity 24C, and thus put under tension. When a force is removed, the middle branch 36A of the leaf spring 36 provides a return force for the cam follower 24.

When the leaf spring 36 is inserted into the cavity 25, it is held in place by a pair of ribs 35. The ribs 35 protrude in the insides of the cavity 25 and are preferably positioned adjacent the bottom part of the cavity 25. The ribs 35 at least partially overlap the outer branches 36B of the leaf spring 36, thus holding the leaf spring 36 inside of the cavity 25. The leaf spring 36 is preferably made of metal. The leaf spring 36 may be also made of any suitable material, such as plastic or material with elastic properties.

An example of a shaver head 40 is shown on FIGS. 3*a*, 3*b*, 5*a* and 5*b*. The shaver head comprises a front wall 44, a back structure 48, a bottom wall 46 and lateral walls 42. The front wall 44 may include a skin engaging element or a guard, preferably made in an elastomeric material. The back wall 43 comprises depressions 41, which accommodate shell bearings 22, positioned at the end of the handle 20. The back structure 48 comprises a rest 43, cooperating with the cam follower 24.

Figure 5A:
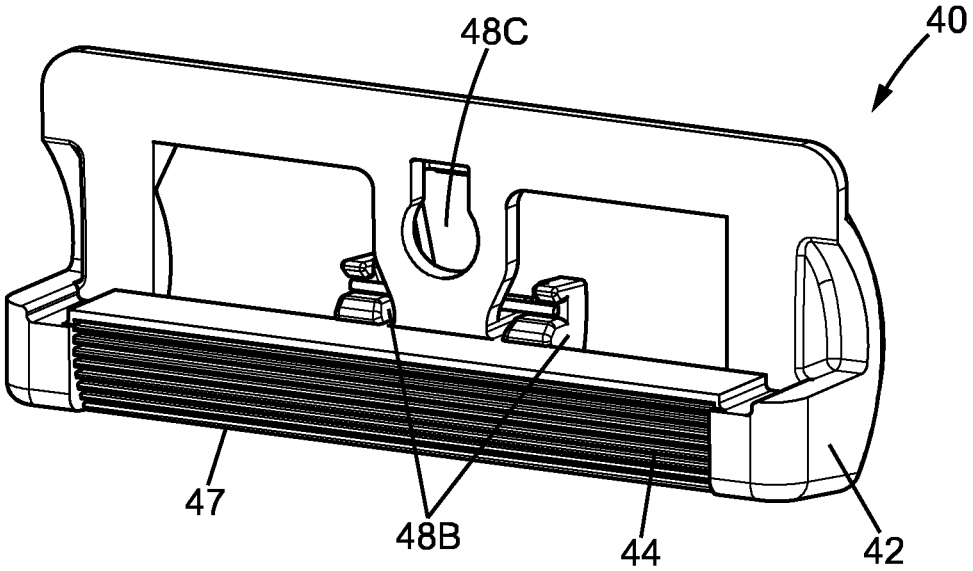
FIG. 5*a* is a front view of the shaver head.
Figure 5B:
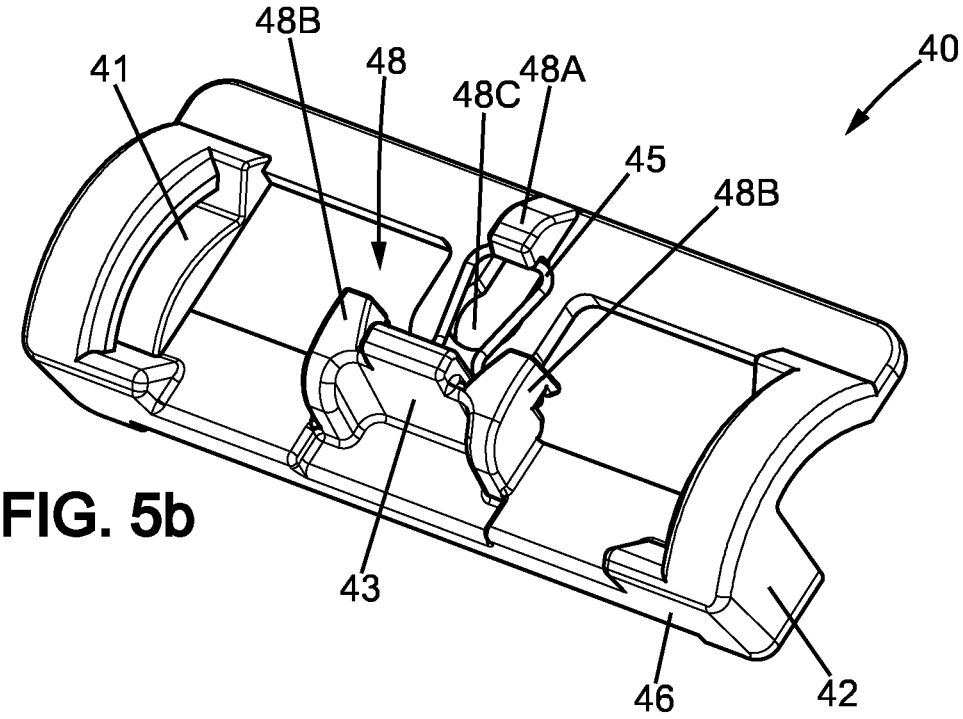
FIG. 5*b* is a back view of the shaver head.

The shaver head 40 forms a seating where the cartridge 60 can be accommodated (detail of such seating is shown on FIG. 5*a*). The cartridge 60 is preferably inserted from a direction perpendicular to the shaving plane.

Once the cartridge 60 is inserted into the shaver head 40, it encounters a spring 45, positioned in the back structure 48 of the shaver head 40. The spring 45 can be seen on FIGS. 3*a* and 3*b*. In the example shown on the Figures, the spring 45 is omega-shaped. The spring 45 comprises end portions 45A and snap-fitting portions 45B.

The back structure 48 of the shaver head 40 comprises a holding portion, adapted to hold the spring 45 in place. In an example shown on the Figures, the holding portion comprises an upper holder 48A, and a pair of lower holders 48B. The holders 48A, 48B may be provided as hook-shaped protrusions, projecting from the shaver head 40 in a direction away from the shaving plane. The holders 48A, 48B preferably hold the spring 45 so that movements of the spring 45 are minimized. The end portions 45A of the spring 45 are inserted into the lower holders 48B. The snap-fitting portion 45B is inserted into the upper holder 48A.

The back structure 48 of the shaver head 40 further comprises an aperture 48C. The aperture 48C is preferably positioned between the holders 48A, 48B, so that when the spring 45 is inserted into the holders 48A, 48B, the spring 45 and the aperture 48C are aligned so that they form a passage.

Between the lower holders 48B, the rest 43 for the cam follower 24 may also be positioned.

The back structure of the cartridge 60 is provided with a holder 65, which can be encountered by the snap-fitting portion 45B of the spring 45. An example of a holder is shown on FIGS. 3*a*, 3*b* and 4. The holder 65 preferably protrudes from the cartridge 60 in a direction away from the shaving plane. The holder 65 is preferably provided as a cylinder-shaped body. The cylinder-shaped body preferably has a circular cross-section. Alternatively, the cylinder-shaped body may have a cross-section of any suitable shape such as a rectangle, a triangle, an ellipse and the like. The cylinder-shaped body may be provided hollow in order to save material and also improve elasticity of the holder 65. The holder 65 is preferably provided with a groove 65A. The groove is preferably positioned in one third to one half of the length of the holder 65.

Once the cartridge 60 is inserted, the holder 65 is encountered by the snap-fitting portion 45B of the spring 45, the snap-fitting portion 45B of the spring 45 holds the holder 65 of the cartridge 60, and thus the cartridge 60 is retained in its seating in the shaver head 40. As the seating provided on the shaver head 40 spans along the whole length of the cartridge 60, unwanted rotation of the cartridge is reduced.

The spring 45 is preferably made of metal, therefore being resilient and not easily destroyed, but may be made in any other suitable elastic material.

Once the cartridge 60 is inserted into the shaver head 40, the cartridge 60 preferably does not perform any movements with respect to the shaver head 40. The shaver head 40 is attached pivotally to the handle 20; preferably, the pivoting means 22, 41 are provided on the shaver head 40 and on the handle 20, but not on the cartridge 60.

The above described mechanism, which uses the spring 45 provided on the shaver head 40 and the holder 65 provided on the cartridge 60, brings about several advantages. The only replaced component is the cartridge 60, which in itself does not hold any additional features (such as pivoting means and the like). Therefore the price of the cartridge 60 may be lowered and the manufacturing process thereof may be simplified; as the shaver head 40 and the handle 20 are not replaced, they may be manufactured as being more robust while keeping the price reasonable. Especially, the means provided to secure the pivoting attachment of the shaver head 40 to the handle 20, may be made more reliable. Moreover, the snap-fitting mechanism is both easy to manufacture and easy to operate. Moreover, there is only one spring 45 provided, which may further reduce costs.

The top part of the handle 20 adjacent the shaver head 40 is also provided with a button 30. An example of the button 30 may be seen on FIGS. 1*b*, 1*c* and 2*a* to 2*d*. The button 30 is provided in a form of a generally box-shaped body which has a front end 30A and a back end 30B. From the front end 30A, a pusher 31 protrudes. The pusher 31 protrudes generally in a direction of the shaving plane.

From the body of the button 30, towards the handle 20, two pairs of arms 33, 34 protrude. The front arms 33 are positioned at the front end 30A of the button 30. The back arms 34 are positioned at the back end 30B of the button 30. At the ends of front arms 33, pegs 33A are positioned. The pegs 33A preferably protrude outwardly from the front arms 33. The ends of the front arms 33 also comprise depressions 33B. The depressions 33B are adapted to accommodate the pegs 24B, which are provided on the cam follower 24.

The button 30 is adapted to be rotated. To facilitate its rotation, the cavity 25 formed between the yokes 21 of the handle 20 is provided with a pair of depressions 26. The depressions 26 are positioned symmetrically at the walls of the cavity 25. The depressions 26 accommodate the pegs 33A, provided on the arms 33 of the button 3. When the pegs 33A are inserted into depressions 26, the button 30 can be rotated about an axis established by the pegs 33A.

To ensure the button 30 to be returned to its initial position after being rotated, the leaf spring 36 is provided. The leaf spring 36 is positioned in the cavity 25. The leaf spring 36 is positioned so that the branches 36B, 36A, 36B are extending towards the shaving plane. The elongated ends of the outer branches 36B are bent upwards, towards the button 30. The outer branches 36B are positioned facing a front surface 33C of the front arms 33 of the button 30. When the button 30 is rotated (as shown on FIG. 1*d*), the elongated branches 36B of the leaf spring 36 are placed under tension. When the force rotating the button 30 is removed, the elongated branches 36B return the button 30 to its initial position. The button 30 also comprises the back arms 34, which ensure that the button 30 is not moved further behind its initial position.

The leaf spring 36 also provides a return force for the cam follower 24. In the embodiment shown on the Figures, the cam follower 24 is inserted into the space formed between the front arms 33 of the button 30. The pegs 24B of the cam follower 24 are accommodated in the depressions 33B of the front arms 33 of the button 30, thus allowing the cam follower to be rotated. The leaf spring 36 is then positioned so as to have its middle branch 36A inserted into the depression 24C of the cam follower 24. When the cam follower 24 is rotated, a wall of the depression 24C bends the middle branch 36A of the leaf spring 36. When the force rotating the cam follower 24 is removed, the middle branch 36A of the leaf spring 36 provides a return force for the cam follower 24.

The button 30 further comprises a finger rest area 32. When the user wishes to disengage the cartridge 60 from the shaver head 40, s/he pushes the button 30. Under the pressure, the button 30 rotates. When the button 30 is rotated (as can be seen on FIG. 1*d*), the pusher 31 encounters the holder 65 of the cartridge 60 and pushes the holder 65. When the pusher 31 pushes the holder 65, the groove 65A is disengaged from the snap-fitting portion 45B of the spring 45 and thus the cartridge 65 is disengaged. In this way, the user does not have to touch the cartridge 60 by his/her fingers and the risk of cutting the user's fingers with the blades 63 is then reduced.

The above described mechanism brings about several advantages. The button 30 as well as the cam follower 24 are simplified, and the number of parts needed is reduced. Therefore, the reliability is increased, the assembly process is simplified and the costs are reduced. The rotating movement of the button 30 is easily achieved, and thus the operation of the button 30 is simplified. When the cartridge 60 is disengaged, the yokes 21 are not moved, which helps prevent their overload and subsequent damage. When the button 30 is pushed, the cam follower 24 does not move, thus the overload of the cam follower 24 is reduced and the reliability is increased. Moreover, when using a rotating movement of the button 30, it is possible to apply the release force to a more precise position, namely to the position when the cartridge 60 is attached, thus achieving higher efficiency of the button 30. In fact, in the shavers known in the art, especially the one-way pivoting shavers, the pivoting axis is usually located approximately at the position of the first blade of the cartridge. The position of the handle and the pivot location cause conflicting vector relations that do not support an efficient push force of the button if a sliding button is used. By using the rotating button 30, the application of the push/release force is closer to the optimum location. Thus, the efficiency of the release button function is enhanced.

To prevent the cam follower 24 or the button 30 from disengaging, the pegs 24B of the cam follower 24 and the pegs 33A of the button are provided in a rectangular shape. In this way, the pegs 24B and 33A may be inserted into the depressions 36 and 33B, respectively, but are prevented from accidental disengaging once all the features of the handle 20 are assembled together.

Moreover, when the components of the handle 20 such as the button 30 and the cam follower 24 are assembled together, they prevent the yokes 21 from being accidentally moved closer together. When the yokes 21 cannot be moved closer together, the risk of the yokes accidentally releasing the shaver head as a whole is reduced, thus reducing risk of injury of the user.

The invention claimed is:

1. A shaver comprising:

a handle with an elongated handgrip portion and a mounting portion, a shaver head pivotally attached to the mounting portion, a removable cartridge comprising at least one blade, the cartridge being adapted to be attached to the shaver head and removed from the shaver head, a spring provided on the shaver head, the spring being adapted to attach the cartridge to the shaver head, a pusher, adapted to encounter the cartridge to release the cartridge from the shaver head, wherein the spring includes at least one part which forms a loop, and wherein the handle further comprises a rotating button, and wherein the button further comprises the pusher, the pusher being adapted to encounter a holder of the cartridge and thus release the cartridge from the shaver head.

2. The shaver according to claim 1, wherein the shaver head further comprises a back structure, and wherein the spring is attached to the back structure of the shaver head.

3. The shaver according to claim 1, wherein the cartridge is ejected in a direction perpendicular to the direction of shaving.

4. The shaver according to claim 1, wherein the spring is made of a curved wire.

5. The shaver according to claim 4, wherein the spring is omega-shaped.

6. The shaver according to claim 1, wherein the spring is made of metal.

7. The shaver according to claim 1, wherein the shaver head further comprises a bottom wall and a guard member, the guard member being positioned adjacent to the bottom wall.

8. The shaver according to claim 1, wherein the holder is provided in a form of a cylinder-shaped body, and the holder is adapted to cooperate with the spring.

9. The shaver according to claim 8, wherein the holder comprises a groove, the groove being adapted to cooperate with the loop formed by the spring.

10. The shaver according to claim 1, wherein the holder is provided in a form of a cylinder-shaped body.

11. The shaver according to claim 10, wherein the holder further comprises a groove.

12. The shaver according to claim 10, wherein the at least one blade is mounted movably.

13. The cartridge shaver according to claim 10, wherein the cartridge further comprises a top wall and a shaving aid, the shaving aid positioned in the top wall.

* * * * *